US007781977B2

(12) United States Patent
Aurongzeb

(10) Patent No.: US 7,781,977 B2
(45) Date of Patent: Aug. 24, 2010

(54) HIGH TEMPERATURE PHOTONIC STRUCTURE FOR TUNGSTEN FILAMENT

(75) Inventor: Deeder M. Aurongzeb, Mayfield Heights, OH (US)

(73) Assignee: General Electric Company, Schenectady, NY (US)

( * ) Notice: Subject to any disclaimer, the term of this patent is extended or adjusted under 35 U.S.C. 154(b) by 724 days.

(21) Appl. No.: 11/642,193

(22) Filed: Dec. 20, 2006

(65) Prior Publication Data

US 2008/0152943 A1 Jun. 26, 2008

(51) Int. Cl.
*H01J 17/04* (2006.01)

(52) U.S. Cl. ..... 313/633; 313/331

(58) Field of Classification Search ..... 428/613, 428/615, 628; 427/209, 383.1, 457, 531; 313/231.61, 311, 633, 331, 332
See application file for complete search history.

(56) References Cited

U.S. PATENT DOCUMENTS

| | | | | |
|---|---|---|---|---|
| 5,079,473 | A | 1/1992 | Waymouth | |
| 2002/0109134 | A1 | 8/2002 | Iwasaki et al. | |
| 2006/0076868 | A1 * | 4/2006 | Pullini et al. | 313/315 |

FOREIGN PATENT DOCUMENTS

| | | | |
|---|---|---|---|
| WO | WO 2004/079056 | A2 | 9/2004 |
| WO | WO 2004/079773 | A2 | 9/2004 |

OTHER PUBLICATIONS

PCT/US2007/085346 International Search Report and Written Opinion, mailed Sep. 17, 2008.

Giermann, et al., "Solid-state dewetting for ordered arrays of crystalographically oriented metal particles", *Applied Physics Letters*, American Institute of Physics, v. 86, No. 12, Mar. 14, 2005, p. 121903.

Bradshaw, "The optical emissivity of titanium and zirconium", *Proceedings of the Physical Society*, Section B, v. 63, Aug. 1, 1950, pp. 573-577.

Wen, et al., "Emissivity characteristics of polished aluminum alloy surfaces and assessment of multispectral radiation thermometry (MRT) emissivity models", *International Journal of Heat and Mass Transfer*, v. 48, No. 7, Mar. 1, 2005, pp. 1316-1329.

Worthing, "Spectral emissivities of tantalum, platinum, nickel and gold as a function of temperature, and the melting point of tantalum", *Physical Review*, v. 128, Jul. 1, 1926, pp. 174-189.

(Continued)

*Primary Examiner*—Joseph L Williams
(74) *Attorney, Agent, or Firm*—Fay Sharpe LLP

(57) ABSTRACT

The invention is directed to a process for the creation of a photonic lattice on the surface of an emissive substrate comprising first depositing a thin film metal layer on at least one surface of the substrate, the thin film metal comprising a metal having a melting point lower than the melting point of the substrate, then annealing the thin film metal layer and the substrate to create nano-particles on the substrate surface, and anodizing or plasma etching the annealed thin film metal and substrate to create pores in the nano-particles and the substrate such that upon exposure to high temperature the emissivity of the substrate is refocused to generate emissions in the visible and lower infrared region and to substantially eliminate higher infrared emission, and to the substrate thus created.

18 Claims, 8 Drawing Sheets

OTHER PUBLICATIONS

Fahrenwald (Database Inspection [Online]), Super-refractory materials for incandescence lighting [with discussion] *The Institute of Electrical Engineers*, 1916 and *Transactions of the American Electrochemical Society*, vol. 30, 1916, pp. 257-364 (database accession No. 1917B00502 Abstract).

Aurongzeb, Deeder, "Interface evolution during electrochemical oxidation-dissolution," *Applied Surface Science*, v. 252, 2005, pp. 872-877.

* cited by examiner

HIGH TEMPERATURE PHOTONIC STRUCTURE FOR TUNGSTEN FILAMENT

BACKGROUND OF THE INVENTION

The present disclosure relates to high temperature electric discharge lamps. It finds particular application with regard to lamps that experience emitted light loss in the infrared region, which generally accounts for an energy loss of up to about 70%. However, it is to be appreciated that the present disclosure will have wide application throughout the lighting and photovoltaic industry.

Resistively or non-resistively heated light sources, including incandescent and discharge lamps, generally lose a majority of the emitted wavelengths in the infrared region of the spectrum, which translates into what may be as high as a 70% energy loss for the lamp to non-visible light output. Of this, roughly 2% may be lost to ultraviolet emissions, while the rest is lost to convection emission. Because this energy remains in the lamp envelope, tungsten, which has a very high melting point, greater than about 3200° C., has historically been employed for use as a filament and electrode material.

With the invention of thin film technology, lamp efficiency increased due to the application of ultraviolet and infrared reflective coatings being applied to the filament and/or electrode to direct at least a portion of the discharge back to the filament. While this technology was able to reduce energy losses with about a 50% efficiency rate, it nonetheless does not address the issue of suppression or conversion of unwanted light emissions.

A means of suppressing unwanted wavelength emissions was disclosed in U.S. Pat. No. 5,079,473. This disclosure is directed to the use of a radiating device having microcavities with a cavity diameter suitable for suppressing 700 nm and above wavelengths. This device, however, suffers from structural instability at temperatures as low as about 1200° C., even though the melting point of tungsten is far above that. Later innovators were able to gain stability at temperatures up to about 2000° C. by employing a nanocavity surface treated with tungsten carbide, or by use of a wire structure made from a refractory material, exhibiting wavelengths of 780 nm or less, and therefore having wavelength suppressing properties above this range.

Another attempt to address the issue involved the transfer of a nanoscale pattern to the filament using a mask of a material such as titanium, chromium, vanadium and tungsten, and their oxides in the presence of a polymer resist to achieve the pattern transfer. Also, alumina film and anodized alumina film have been used to generate pore structures on substrates, and plasma etching techniques have been used to generate surface roughness, or mounds, that increase the emissivity of tungsten.

The foregoing, while advancing the technology to some degree, fail to fully address the issue of wavelength suppression and shift to generate emissions of the shifted wavelengths in the visible range, thus increasing lamp efficiency. The invention disclosed herein is intended to provide a process for the creation of a photonic lattice on the surface of an emissive substrate comprising first depositing a thin film metal layer on at least one surface of the substrate, the thin film metal comprising a metal having a melting point lower than the melting point of the substrate, then annealing the thin film metal layer and the substrate to create nano-particles on the substrate surface, and anodizing the annealed thin film metal and substrate to create pores in the nano-particles and the substrate such that upon exposure to high temperature the emissivity of the substrate is refocused to generate emissions in the visible and lower infrared region and to substantially eliminate higher infrared emission, and the substrate thus created.

BRIEF DESCRIPTION OF THE INVENTION

An electric discharge lamp is provided which includes emission components capable of generating a wavelength shift, or suppression of emissions, where the suppressed wavelength is emitted in the form of visible light, thus increasing lamp efficiency. Lamp energy, which has heretofore been lost at a rate of up to about 70% in the form of UV and IR emissions, is more efficiently utilized as light in these wavelengths. Rather than being merely reflected, the lamp emissions are suppressed and refocused for emission in the visible range. The process disclosed herein provides a method to generate a photonic lattice on a substrate of tungsten or other similar substrate material, which may be flat or curved in nature. The photonic lattice exhibits periodic or quasi-periodic oscillation of dielectric constant, the size and shape of which manipulate electromagnetic radiation to emit in a desired frequency or wavelength. The lattice may be applied to any surface, curved or flat, omni-directional or bi-directional. Also provided are materials suitable for use in generating the photonic lattice.

DETAILED DESCRIPTION OF THE INVENTION

Figure 12:
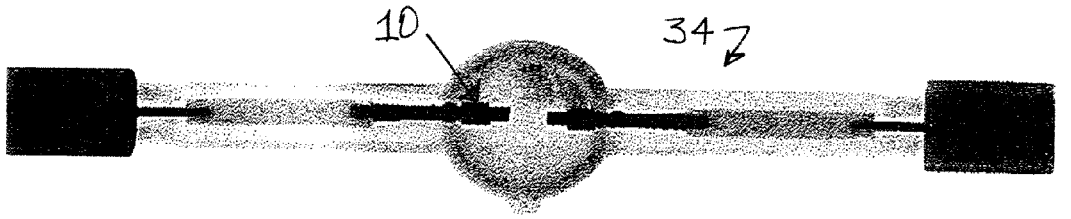
FIG. 12 is a diagram of a non-resistively heated light source according to the invention.
Figure 13:
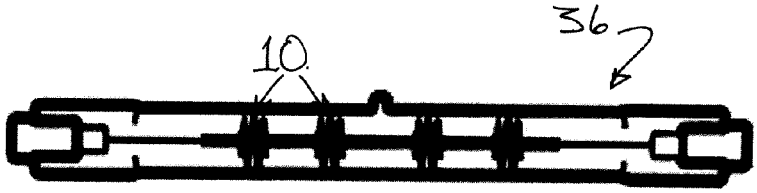
FIG. 13 is a diagram of a resistively heated light source according to the invention.
Figure 14:
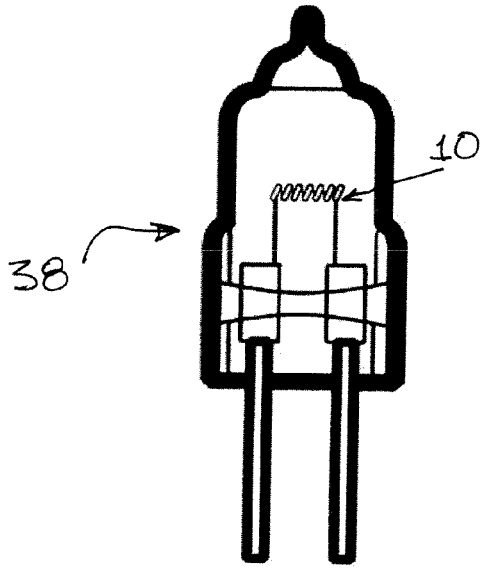
FIG. 14 is a diagram of a resistively heated light source according to the invention.

With reference to FIGS. 12-14, there are various embodiments of lamps in accord with the subject invention. In particular, FIG. 12 shows a non-resistively heated light source 34 comprising at least a substrate 10 upon which a thin film metal layer in accord with the invention has been deposited, as detailed in the following disclosure and remaining FIGS.

Figure 1:
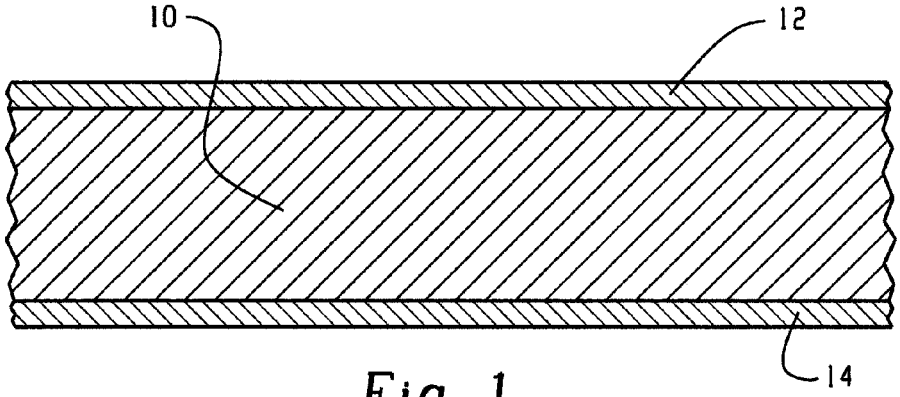
FIG. 1 is a diagram of a substrate according to the invention.

1-12. Similarly, FIGS. 13 and 14 show resistively heated light sources, 36 and 38, each comprising at least a substrate 10 upon which a thin film metal layer in accord with the invention has been deposited. Now, with respect to FIG.1, substrate 10, which may be tungsten, magnesium oxide, or any other suitably emissive substrate material, bears a thin metal film 12. Thin metal film 12 may be deposited by electron beam or ion sputtering onto substrate 10, which may be flat or curved. In that instance where substrate 10 is flat, deposition of the thin metal film may be done on both sides of the substrate generating thin film 12 and thin film 14, which may or may not be of the same composition. Though it is not shown herein, the substrate may also be curved in which case the thin film may be deposited in a layered manner. For example, up to 100 nm of thin film may be deposited in increments, or layers, of progressing thickness, i.e., 1 nm, 5 nm, 10 nm, 20 nm, etc., the size and separation of each layer varying linearly with temperature, such that problems of cracking are avoided.

With regard to the pairing of substrate and thin film materials suitable for use in this process, it is important that the substrate exhibit a melting point greater than that of the thin film. The substrate may be single crystal or re-crystallized, such as tungsten, osmium, rhenium and tantalum, and may further include the oxides or nitrides of these and other like materials. The variation in melting point, with that of the substrate being greater than that of the thin film, reduces the possibility of interface diffusion occurring. Interface diffusion may compromise the structural integrity of the substrate and thus its performance.

Figure 2:
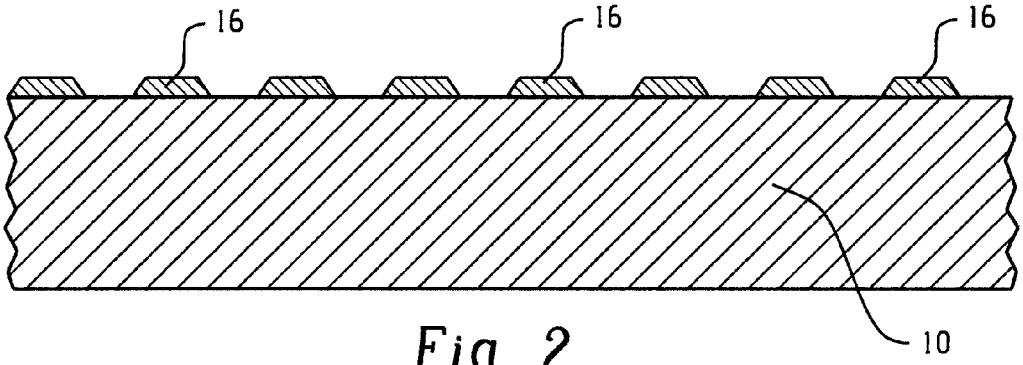
FIG. 2 is a diagram of a substrate having nano particles annealed on the surface thereof.
Figure 3:
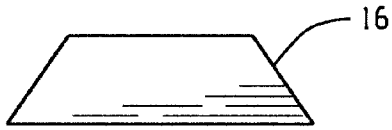
FIG. 3 is a diagram of a nano particle having faceted surfaces.

The thin metal film, 12 and/or 14, may be comprised of nano particles of the desired metal, selected from low melting point metals, with respect to the melting point of the substrate, such as for example aluminum, zinc, tin, titanium, their alloys, and other similar metals and their alloys. As has been previously pointed out, it is important that the relationship of the substrate and thin film, with regard to melting point be X: <X, where X is the melting point of the substrate material. The nano particles of the thin film metal undergo rapid thermal annealing in the presence of the substrate for up to about 10 minutes depending on the thickness of the film and the melting point of the material. This is accomplished at a temperature that is 0.9×. FIG. 2 is a diagram exhibiting a substrate 10 wherein the annealed nano particles 16 are multi faceted, as shown in greater detail in FIG. 3. The angle of the faceted surfaces is preferably less than 50°.

The annealing process may result in ordered or random particle location on the substrate surface. Surface nucleation sites determine if the particle locations are ordered or random in nature. While ordered location is preferred, random location can nonetheless increase lamp efficiency by 50%. If the particles are ordered in their arrangement, ion milling or another similar process can be used to create defect sites. The nano dots will diffuse only to the defect sites, and eventually the surface of substrate 10 will become once again ordered with regard to the nano particle positions.

Once the annealing step of the process has been completed, the substrate 10 is anodized, in an anodizing solution such as sulfuric acid, phosphoric acid, a solution of 1:1 phosphoric acid:NaOH acid, or another similar solution. In the alternative, the annealed surface 16 of substrate 10 may be etched by inductive coupled plasma processing. The choice of anodizing agent is determined by the metal used to create the nano particles 16. For example, when the metal used is gold, it may be preferable to use potassium iodide as an anodizing solution.

Figure 4:
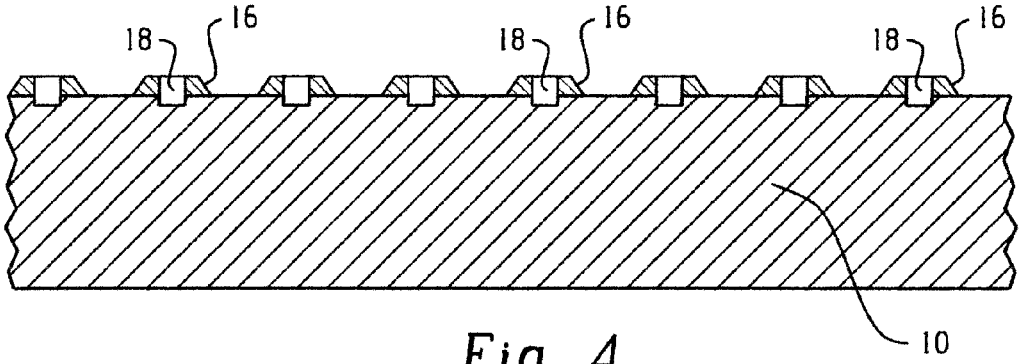
FIG. 4 is a diagram representing nano dot positions according to the invention.
Figure 5:
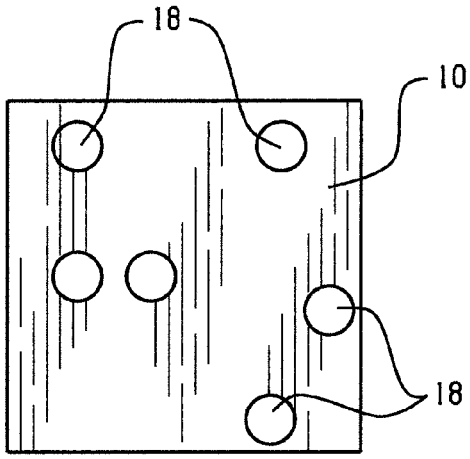
FIG. 5 is a diagram of a substrate according to the invention after etching.
Figure 6:
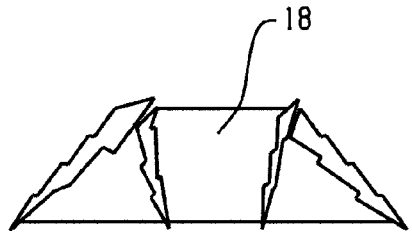
FIG. 6 is a diagram of an individual nano dot showing stepped etched wall surfaces.
Figure 11:
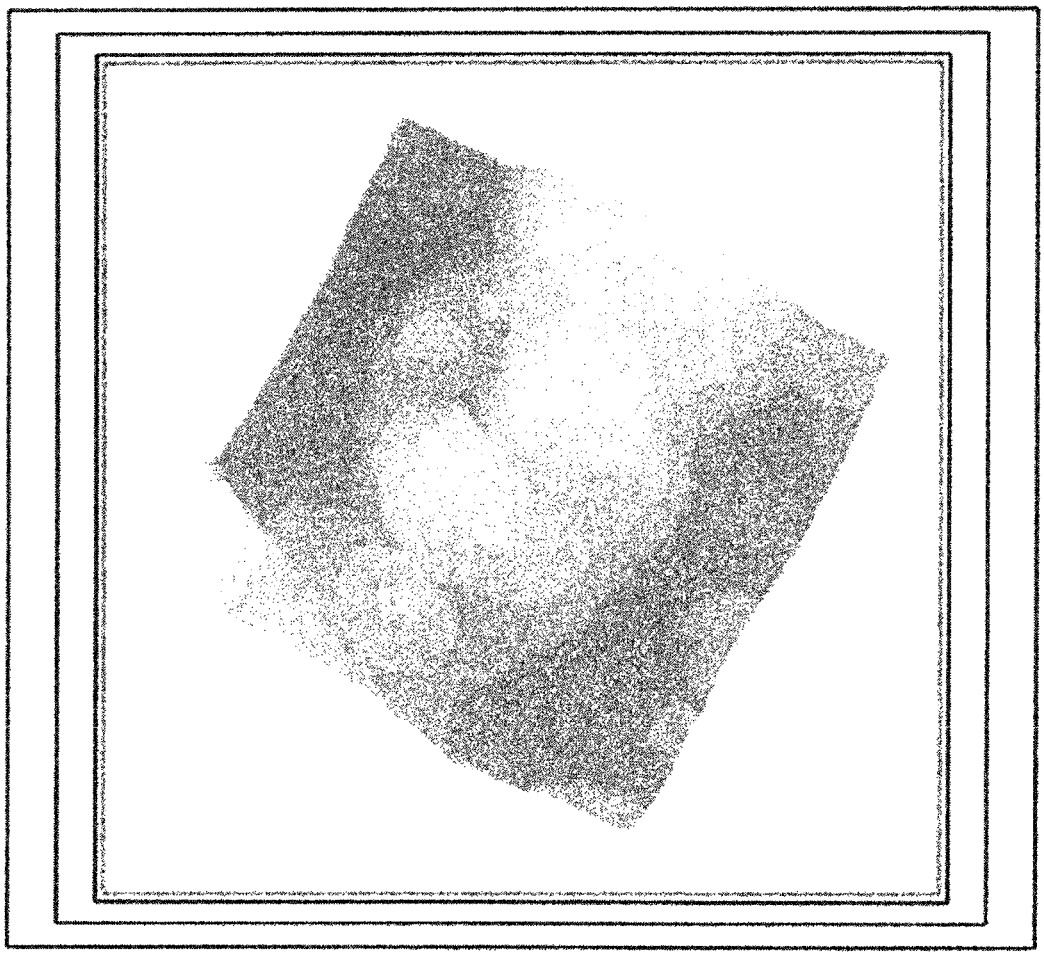
FIG. 11 is a diagram of an individual nano dot showing stepped etched wall surfaces.

With respect to FIG. 4, nano dots 18 are formed in the nano particles 16. FIG. 5 is a diagram further representing substrate 10, having deposited thereon annealed nano particles 16 bearing anodized nano dots 18. The nano dots are actually channels in the nano particles. Each channel has stepped and slanted side walls, which may be rough in nature, as shown in FIG. 6 which is a diagram of an individual nano dot. In addition, FIG. 11 is another view of the same pore area. The anodized substrate surface having the nano dots functions in the same manner as prior art masking materials to etch the emissive surface of substrate 10. The substrate metal may be any metal, or oxide or nitride, having a melting point X in excess of 2000° C. While this method of anodizing represents an electrochemical etching process, the same may be accomplished using plasma etching or other etching techniques known in the art. However, the anodization etching method disclosed herein results in pore walls having stepped surfaces that are rough in nature. This is important to creating the largest surface area possible, which results in amore efficient suppression of undesirable wavelength emissions.

Figure 7:
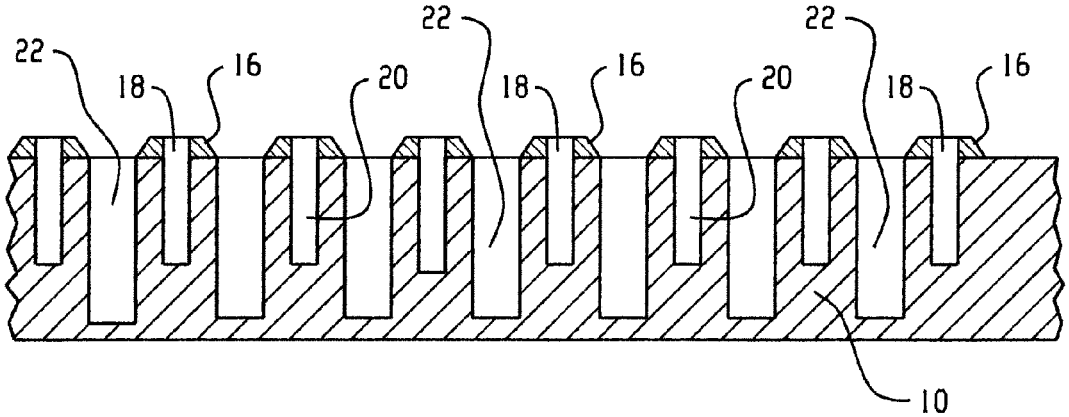
FIG. 7 is a diagram of a fully etched substrate according to the invention.

In that instance where the substrate is tungsten, as with many lamps, the etching process can be carried out in a sodium hydroxide solution, for example under 0.14 volts direct current with 40 milli amps current, though selection of the operational parameters of the process are within the purview of the skilled artisan. The anodized and etched substrate is shown in the FIG. 7 diagram, exhibiting substrate 10 having etched pores 20 and 22. Pores 20 are etched in the nano dots 18, while pores 22 are etched in substrate 10 between the nano particles 16. The presence of both types of pores increases the pore density due to the difference in the size thereof. While pores through the nano dots give photonic effect, those pores in the substrate increase emissivity of the substrate.

Figure 8:
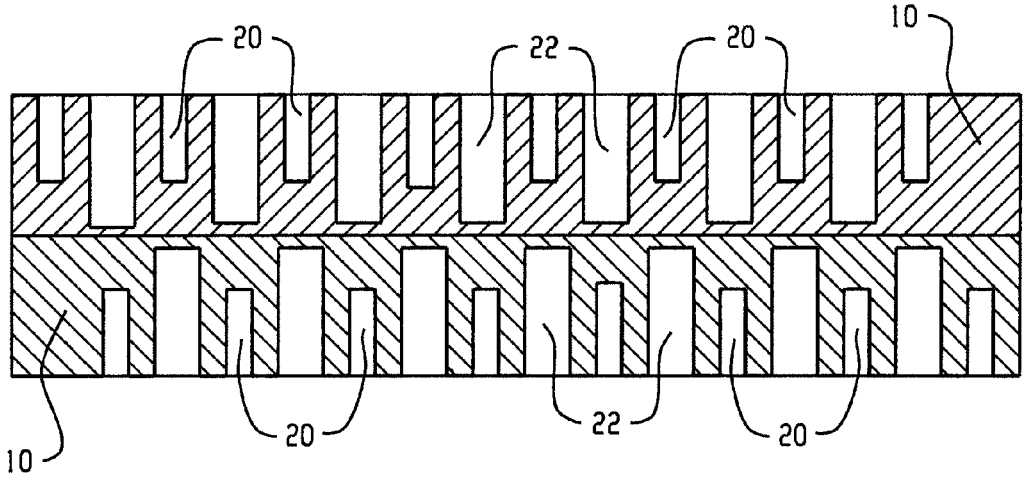
FIG. 8 is a diagram of a bi-directionally etched substrate according to the invention.
Figure 9A:
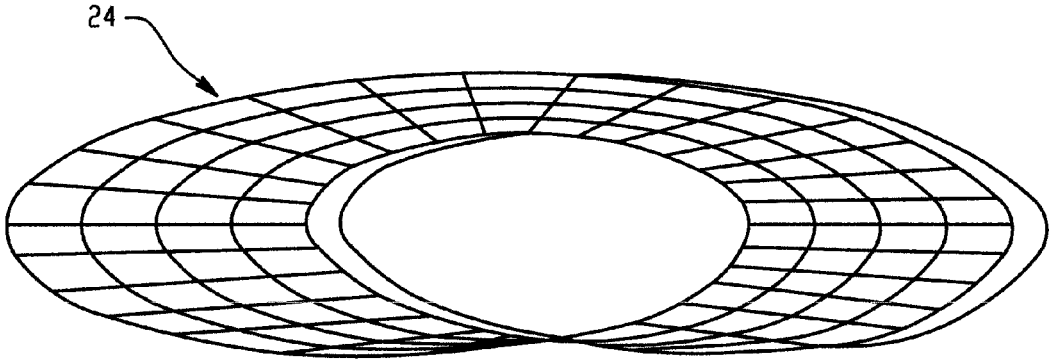
FIG. 9 is a diagram of a curved substrate surface bearing nanodots covered with a film.
Figure 9B:
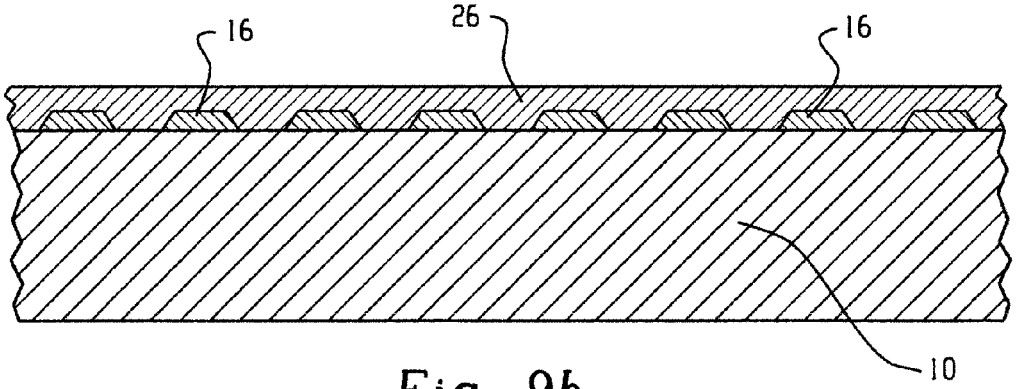

The process described above results in a bidirectional structure such as that shown in FIG. 8 when applied to a flat substrate surface. If the substrate is curved, however, the structure would appear in keeping with that shown in FIGS. 9*a* and 9*b*. FIG. 9*a* sets forth an example of a curved surface 24. That surface 24 bears nano particles 16 in keeping with prior disclosure, and though not shown, also bears nano dots and pores. In addition, the outer surface of the substrate 10 is covered in total or in part with an oxide, nitride, or carbide thin film 26 of, for example, Zr, Hf, Mg, or other similar metal. Other high melting point combinations exhibiting a melting point in excess of about 2000° C. may also be used.

Figure 10A:
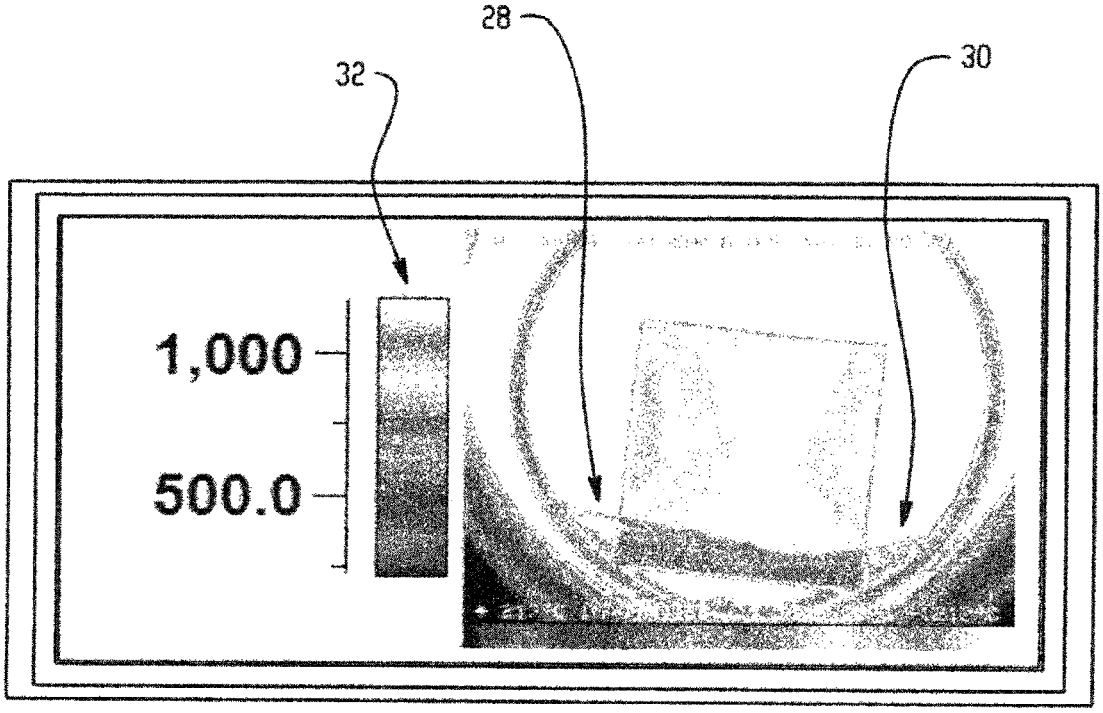
FIG. 10*a* is a representation of the heat profile of a prior art wire as compared to a wire according to the invention.
Figure 10B:
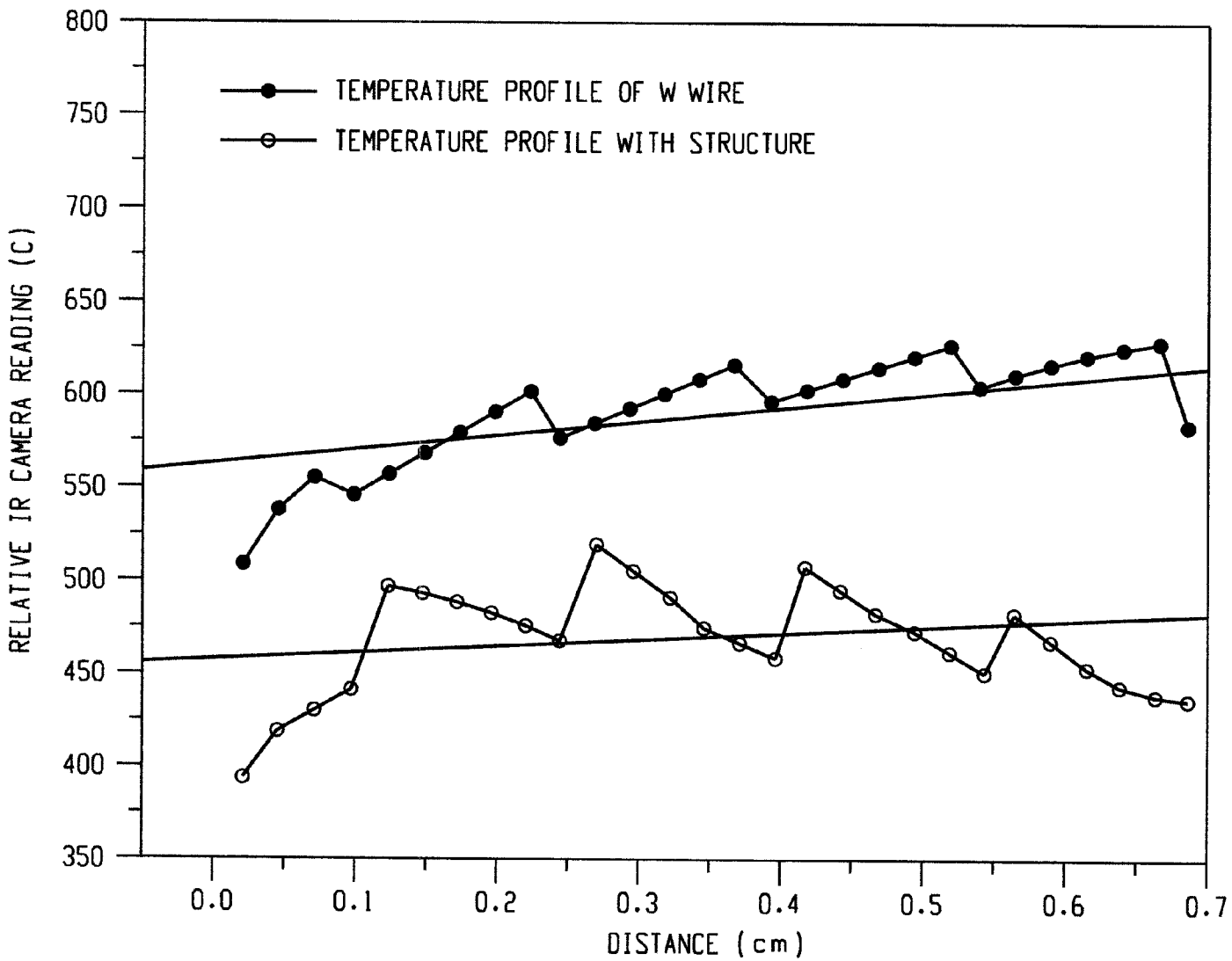
FIGS. 10*b* and 10*c* are graphs showing wavelength data corresponding to a wire according to the invention.
Figure 10C:
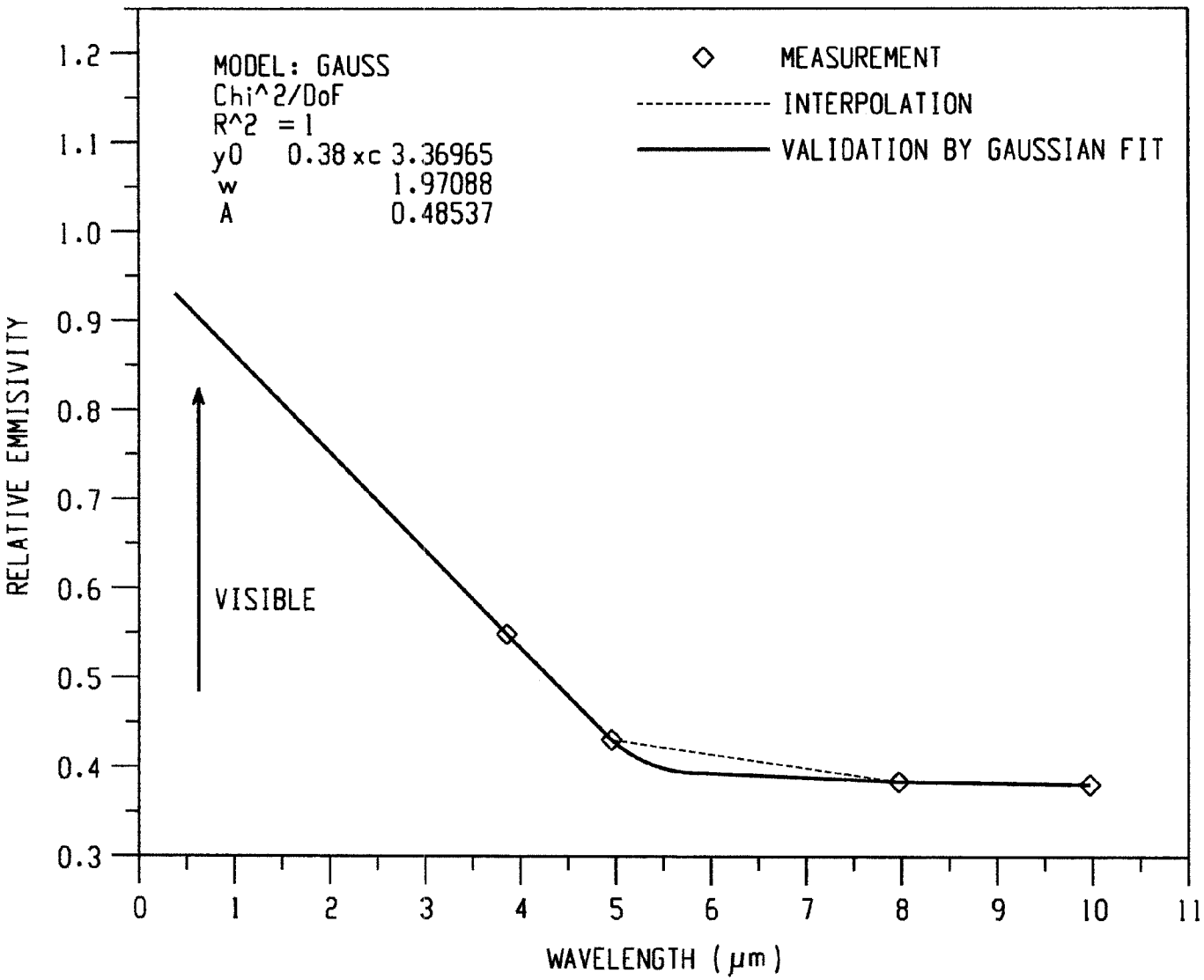

Using the process described above, a thin film of aluminum was deposited on a tungsten filament by vapor deposition processing. This metal film was then anodized and etched in a sodium hydroxide solution to create pores in the substrate surface in keeping with the foregoing disclosure. With reference to FIGS. 10*a* through 10*c*, an opaque block is seen, which is used to maintain two tungsten wires in position while they are simultaneously exposed to high temperature. On the left of the block is a prior art tungsten wire 28, while the wire 30 on the right of the block bears the current coating structure. As can be seen, the wire 30 with the current coating structure shows a lower emission corresponding to wavelength shift than that seen with the prior art wire 28 on the left. With reference to the temperature profile 32 shown to the left of the FIG. 10*a*, it appears that the wire on the left 28 is generating more white space, corresponding to a generation of higher wavelengths in the IR region. The right hand wire 30, according to the invention, appears to be generating much less higher wavelength emission. The filters used to create these profiles are from 3.9 to 10 microns, which means that the wire 30, bearing the photonic lattice structure according to the invention, is suppressing infrared emission thus creating the desired photonic effect. To be useful, the photonic lattice should suppress infrared emissions above 900 nm, which is evident from the profiles provided. FIG. 10*b* is a graph of the temperature profile of a prior art wire as compared to the inventive wire bearing the photonic lattice structure. FIG. 10*c* is a graph of the emission of visible wavelengths when using a wire bearing the photonic lattice structure.

Annealing of the substrate at a temperature greater than 1500° C. for more than 30 minutes allows a reduction in surface/volume defects and creates large grain sizes. In addition, the use of substrate materials such as zirconium oxide, hafnium oxide, magnesium oxide or their nitrides, having a thickness of less than about 20 nm, enhances structure stability due to the high melting point and reduced mobility of these materials.

The invention has been described with reference to the preferred embodiments. Obviously, modifications and alterations will occur to others upon reading and understanding the preceding detailed description. It is intended that the invention be construed as including all such modifications and alterations.

The invention has been described with reference to the preferred embodiments. Obviously, modifications and alterations will occur to others upon reading and understanding the preceding detailed description. It is intended that the invention be construed as including all such modifications and alterations.

What is claimed is:

1. A light source comprising emissive components having deposited thereon a thin film metal layer in the form of a photonic lattice comprising discreet nano-particles, the light source exhibiting a suppression of emissions in excess of 900 nm and a shift thereof to wavelengths in the visible or lower infrared spectrum during operation.

2. The light source of claim 1 wherein the emissive components are substantially flat and the thin film metal layer is deposited on both sides.

3. The light source of claim 2 wherein the thin film metal layer deposited on one side differs in composition from the thin film metal layer deposited on the opposing side.

4. The light source of claim 1 wherein the emissive components are generally curved and the thin film metal layer comprises multiple incremental layers of the thin film metal.

5. The light source of claim 1 wherein the emissive components have a melting point in excess of 2000° C., and the thin film metal layer has a melting point less than that of the emissive components.

6. The light source of claim 5 wherein the emissive components comprise a metal or metal compound selected from the group consisting of tungsten, osmium, rhenium, tantalum, the oxides thereof, and the nitrides thereof.

7. The light source of claim 5 wherein the thin film metal layer contains a metal selected from the group consisting of aluminum, zinc, tin, titanium and the alloys thereof.

8. The light source of claim 5 wherein the thin film metal layer comprises a plurality of nano particles.

9. The light source of claim 8 wherein the location of the nano particles on the surface of the emissive components is ordered.

10. The light source of claim 8 wherein the location of the nano particles on the surface of the emissive components is random.

11. The light source of claim 5 wherein the emissive components and thin film metal layer have pores in the surface thereof.

12. The light source of claim 11 wherein the pores have irregularly stepped side walls.

13. The light source of claim 1 wherein the emissive components exhibit periodic or quasi-periodic oscillation of dielectric constant, the size and shape of which manipulate electromagnetic radiation to emit in visible or lower infrared frequencies.

14. The light source of claim 1 wherein the emissive components comprise a metal or metal compound selected from the group consisting of tungsten, osmium, rhenium, tantalum, the oxides thereof, and the nitrides thereof.

15. The light source of claim 14 wherein the thin film metal layer contains a metal selected from the group consisting of aluminum, zinc, tin, titanium and the alloys thereof.

16. The light source of claim 15 wherein the thin film metal layer and the emissive components have pores in the surface thereof.

17. The light source of claim 1 wherein the light source is a resistively heated light source.

18. The light source of claim 1 wherein the light source is a non-resistively heated light source.

* * * * *